US006226027B1

(12) United States Patent
Ashida et al.

(10) Patent No.: US 6,226,027 B1
(45) Date of Patent: May 1, 2001

(54) ELECTROPHOTOGRAPHY APPARATUS AND EXPOSING UNIT THEREFOR

(75) Inventors: Kenichi Ashida; Norio Nakajima, both of Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 09/362,023

(22) Filed: Jul. 28, 1999

(30) Foreign Application Priority Data

Jul. 31, 1998 (JP) ..... 10-216684

(51) Int. Cl.[7] ..... B41J 15/14
(52) U.S. Cl. ..... 347/242; 347/130; 347/237
(58) Field of Search ..... 347/242, 134, 347/237, 247, 112, 118, 128, 137, 140, 141, 151, 130; 399/71, 98, 99, 343, 358

(56) References Cited

U.S. PATENT DOCUMENTS 5,790,920 8/1998 Teramura et al. ..... 399/71

FOREIGN PATENT DOCUMENTS 63-208878 8/1988 (JP) .

*Primary Examiner*—N. Le
*Assistant Examiner*—Lamson D. Nguyen

(74) *Attorney, Agent, or Firm*—Rabin & Champagne, PC

(57) ABSTRACT

An electrophotography apparatus has a charging unit, and an exposing unit, and a developing unit. The charging unit charges the surface of a rotating image bearing body having an axis of rotation. The exposing unit emits light to illuminate the surface of the image bearing body to form an electrostatic latent image on the surface. The developing unit applies charged toner to the electrostatic latent image to develop the electrostatic latent image into a visible image. The electrophotography apparatus includes, for example two electrodes and power supplies for applying voltages to the electrodes. The electrodes are disposed between the light-emitting surface of the exposing unit and extend parallel to the axis of rotation of the image bearing body. The electrodes are aligned on opposite sides of the light emitted from the exposing unit. The electrodes receive voltages from the power supplies, creating electric lines of force at an angle with a direction of the light so that the charged toner particles remaining on the image bearing body fly in a direction deviating from the direction of the light. The electrodes may be disposed in a plane perpendicular to the direction of light and receive voltages of different values from each other and of the same polarity as the charged powdered particles. The electrodes may be disposed in different planes perpendicular to the direction of light, one of the electrodes being closer to the image bearing body than the other.

4 Claims, 7 Drawing Sheets

ELECTROPHOTOGRAPHY APPARATUS AND EXPOSING UNIT THEREFOR

FIELD OF THE INVENTION

The present invention relates to an electrophotography apparatus such as electrophotographic printers and copying machines, and more particularly to an exposing unit having an electrode that prevents soiling of the exposing unit with toner.

DESCRIPTION OF THE PRIOR ART

An electrophotographic printer is a well-known prior art apparatus that performs the steps of charging, exposing, developing, transferring, and fixing. For example, Japanese Patent Preliminary Publication (KOKAI) No. 63-208878 discloses an electrophotography apparatus in which the surface of a photoconductive body is uniformly charged by the contact charging method.

An exposing unit for an electrophotography apparatus usually takes the form of a semiconductor laser or an LED (light emitting diode) head. A semiconductor laser type exposing unit requires a polygon mirror and a f θ lens, making the electrophotography apparatus large in size. An LED type exposing unit is in the form of a combination of light emitting diodes with a SELFOC lens, lending itself to a miniaturizing of the electrophotography apparatus.

FIG. 9 illustrates a general construction of a conventional exposing unit.

An LED print head 10 includes an LED array 1, an LED board 2, a base 3, a SELFOC lens array (referred to as SLA hereinafter) 5, and an SLA holder 6. The LED array 1 is an array of a plurality of light emitting diodes arranged in a long row. The LED array 1 is mounted on the LED board 2. The base 3 supports the LED board 2 thereon. The SLA 5 illuminates the surface of a photoconductive drum 4 to form an electrostatic latent image on the surface as the photoconductive drum 4 rotates about an axis parallel to the direction of the row of light-emitting diodes in the LED array 1.

During the exposing process, the LED print head 10 receives print data from a main body of a printer, not shown, and energizes the LED array 1. When an LED is energized to emit light, the light is directed through the SLA 5 to the uniformly charged surface of the photoconductive drum 4, thereby forming an electrostatic latent image on the surface. The electrostatic latent image is subsequently developed with colored toner, charged to a certain potential. As the photoconductive drum 4 rotates, the developed image reaches a transfer unit where the developed image is transferred to a recording medium. The recording medium is then advanced to a fixing unit where the developed image is fused into a permanent image.

The subsequent cleaning process removes the residual that still remains on the surface of the photoconductive drum 4.

The LED printhead 10 is effective in miniaturizing a printer. In order to form an image of the light emitted by the LEDs, the aforementioned LED array 1 is disposed such that the surface of the lens of the SLA 5 is very close to the charged surface of the photoconductive drum 4 (e.g., 2–5 mm).

With the aforementioned electrophotography apparatus, some of the toner cannot be transferred from the photoconductive drum 4 to the recording medium and remains on the photoconductive drum 4. The residual toner is carried to the exposing unit, i.e., the LED printhead 10 as the photoconductive drum 4 rotates.

There occurs an electric field between the negatively charged surface of the photoconductive drum 4 and the LED printhead 10 at the ground potential. Thus, the residual toner is pulled toward the SLA 5 and adheres to the SLA 5. The toner adhering to the SLA 5 not only reduces the effective amount of light emitted from the LED printhead 10 but also presents a problem of poor print quality.

SUMMARY OF THE INVENTION

The present invention was made in view of the aforementioned drawbacks.

An object of the invention is to provide an electrophotography apparatus that provides stable print quality.

Another object of the invention is to provide an exposing unit having an electrode that prevents the soiling of the printhead with toner.

An electrophotography apparatus has a charging unit, and an exposing unit, and a developing unit. The charging unit charges the surface of a rotating image bearing body, for example, photoconductive drum having an axis of rotation. The exposing unit emits light to illuminate the surface of the image bearing body to form an electrostatic latent image on the surface. The developing unit applies charged fine powder particles (i.e., toner) to the electrostatic latent image to develop the electrostatic latent image into a visible image. The electrophotography apparatus includes at least one power supply and a plurality of electrodes supplied with voltages therefrom. The electrodes are disposed between the light-emitting surface of the exposing unit and extend parallel to the axis of rotation of the photoconductive drum. The electrodes are aligned on opposite sides of the light emitted from the exposing unit. The electrodes receive voltages from the power supply, creating electric lines of force at an angle with the direction of the light so that the charged powered particles remaining on the image bearing body fly in a direction deviating from the direction of light.

The electrodes include a first electrode and a second electrode that are disposed in a plane perpendicular to the direction of light. The first and second electrodes may receive voltages of different values and of the same polarity as the charged powdered particles.

The first and second electrodes may be disposed in different planes perpendicular to the direction of light, the first electrode being closer to the image bearing body than the second electrode. Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE INVENTION

Figure 1:
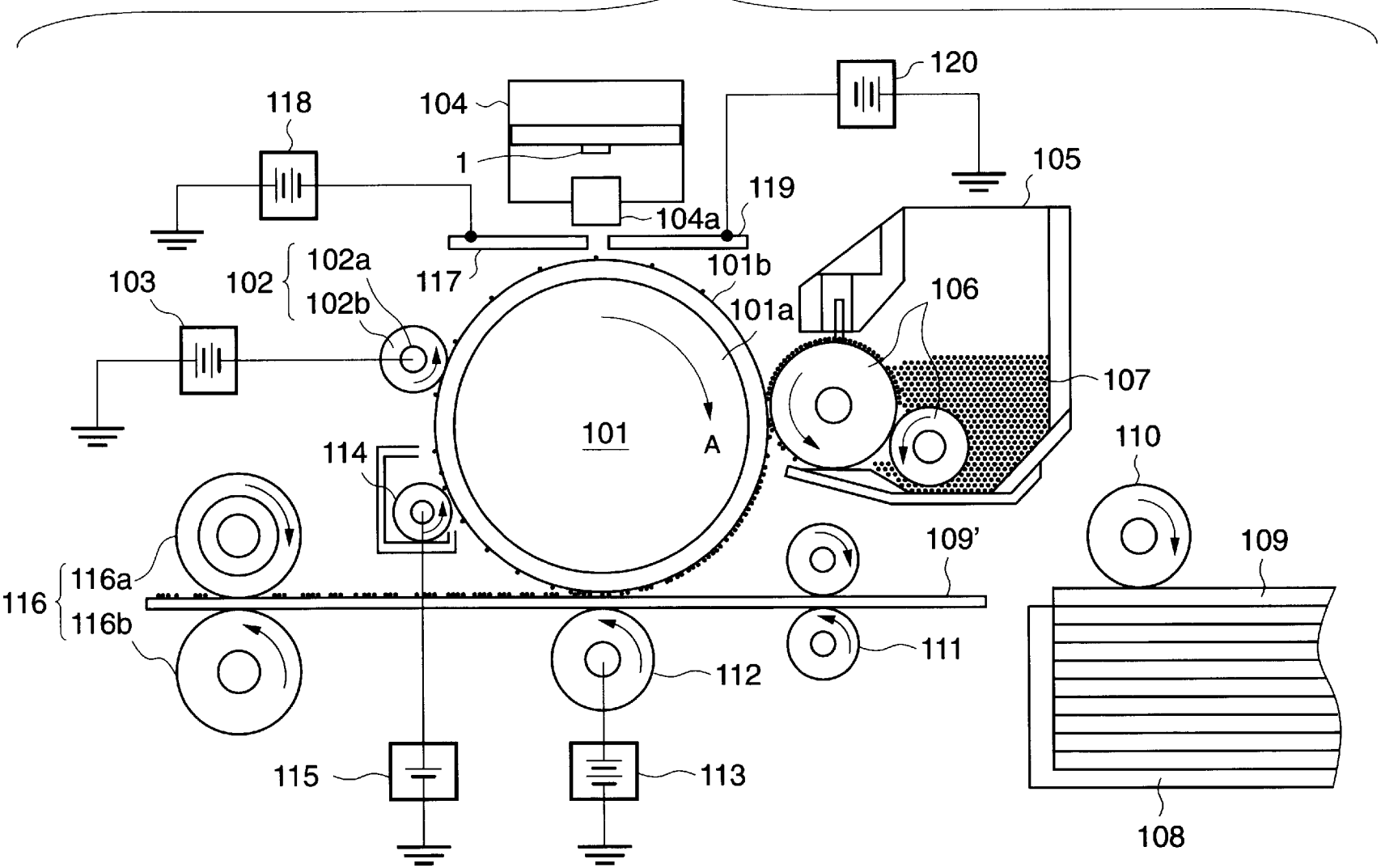
FIG. 1 illustrates a general construction of an electrophotography apparatus according to a first embodiment of the present invention.

Preferred embodiments of the present invention will be described in detail with reference to the accompanying drawings.

Elements of the same construction have been given the same reference numerals throughout the embodiments and the description thereof is omitted.

First Embodiment

<Construction>

FIG. 1 illustrates a general construction of an electrophotography apparatus according to the present invention. The electrophotography apparatus is provided with electrodes that prevent toner from adhering to the exposing unit.

The apparatus includes an electrostatic latent image bearing body (e.g., photoconductive drum) 101, a charging unit (e.g., charging roller) 102, a charging power unit 103, an exposing unit (e.g., LED printhead) 104, and a developing unit (e.g., developing roller) 105. The charging unit 102 includes a metal shaft 102*a* and a semiconductive rubber layer 102*b* formed thereon. The exposing unit 104 has an SLA (SELFOC lens array) 104*a*. The developing unit 105 includes a toner bearing body 106 to which a predetermined amount of toner 107 is supplied. Toner is powdered particles and is charged before it is applied to the electrostatic latent image formed on the image bearing body 101.

The image bearing body 101 is of a drum shape and is driven in rotation by a drive means, not shown. The image bearing body 101 rotates at a constant peripheral speed in a direction shown by arrow A. The image bearing body 101 includes a conductive support 101*a* and a photoconductive layer 101*b* provided on the conductive support 101*a*. The photoconductive layer 101*b* is in the form of, for example, an organic photoconductive material. Other photoconductive materials such as selenium photoconductor, zinc oxide photoconductor, amorphous silicone photoconductor can also be used. The exposing unit 104 is a combination of an LED array 1 and SLA 104*a* but a combination of a laser light source and image forming optical system may also be used.

The operation of the electrophotography apparatus shown in FIG. 1 will be described.

Electrophotography includes charging, exposing, developing, fixing, and cleaning, through which an image is recorded. The image forming process will be described.

The charging unit 102 is in contact with or in pressure contact with the surface of the image bearing body 101. The semiconductive rubber layer 102*b* is uniformly charged by a high voltage of about −1350 V, then the semiconductive rubber layer 102*b* in turn uniformly charges the surface of the electrostatic latent image bearing body 101 to about −800 V.

The exposing unit 104 is held to oppose the surface of the image bearing body 101. The exposing unit 104 illuminates, during a printing operation the charged surface of the image bearing body 101 in accordance with image data, thereby forming an electrostatic latent image on the image bearing body 101. The potential of illuminated areas is about −50 V and the potential of non-illuminated areas is about −800 V.

The developing unit 105 is held in contact with the image bearing body 101 or with a very small gap between the image bearing body 101. The developing unit 105 incorporates a toner bearing body 106 constructed of a plurality of rollers. The rollers apply the toner 107 to the image bearing body 101 such that the toner 107 is attracted to the electrostatic latent image. The embodiment uses reversal development. A power supply, not shown, applies a bias voltage of about −400 V across the conductive support 101*a* of the image bearing 101 and toner bearing body 106. An electric field is developed between the toner bearing body 106 and the electrostatic latent image on the image bearing body 101. As a result, the negatively charged toner on the toner bearing body 106 is attracted by Coulomb force to the exposed areas (electrostatic latent image) on the image bearing body 101 so that the electrostatic latent image is developed with the toner into a toner image.

The reverse development can be achieved by using any of known developing units such as a two-composition magnetic brush type developing unit, a one-composition magnetic brush type developing unit, and a one-composition non-magnetic developing unit.

Paper 109 accommodated in a paper cassette 108 is advanced by a feeding roller 110 to registry rollers 111. The paper 109 abuts the stationary registry rollers 111, so that the position of the paper 109 is corrected if it is skewed. Then, the registry rollers 111 are then driven into rotation to advance the paper 109 to the transfer unit 112 disposed in opposition to the image bearing body 101. The image bearing body 101 transfers the toner image on the image bearing body 101 to the paper 109.

Thereafter, the paper 109 is transported to a fixing unit 116. The fixing unit 116 includes a pressure roller 116*a* and a heat roller 116*b*. The toner image is fused by the heat generated by the heat roller 116*b*, and penetrated by the pressure roller 116*a* into the fibers of the paper 109. Thus, the image is fixed to the paper 109. The paper 109 is then discharged out of the apparatus.

Some of the toner 107 may be left on the image bearing body 101 after transferring. In order to remove the toner remaining on the image bearing body 101, a cleaning roller 114 is disposed in contact with the image bearing body 101. However, the cleaning roller 114 cannot completely remove the residual toner on the image bearing body 101, so that a very small amount of toner still remains on the image bearing body 101. When the residual toner reaches the exposing zone as the image bearing body 101 rotates, the residual toner flies into the air due to Coulomb force acting between the exposing unit 104 and the image bearing body 101. The residual toner is attracted to the light-emitting surface, i.e., lens surface of the exposing unit 104.

In order to prevent the toner from flying, a pair of electrodes 117 and 119 are disposed in a plane between the exposing unit 104 and the image bearing body 101, the plane being substantially perpendicular to the direction of light of the exposing unit 104. The electrodes 117 and 119 are disposed on opposite sides of the light and extend parallel to the axis of rotation of the image bearing body 101. The electrode 117 is located closer to charging unit 102 than the electrode 119, and the electrode 119 is located closer to the developing unit 105 than the electrode 117. The electrodes are spaced apart by a predetermined distance, for example, 2 to 3 mm with the light emitted from the exposing unit 104 passing therebetween. The electrode 117 is connected to an external high voltage power supply 118 and the electrode 119 is connected to an external high voltage power supply 120. The electrodes 117 and 119 produce an electric field which causes the flying path of the toner 107 to deviate from the lens surface of the exposing unit 104. Sufficiently high voltages are applied to the electrodes 117 and 119 so that the lens surface of the exposing unit 104 is always maintained clean, thereby ensuring high print quality.

The electrodes 117 and 119 are spaced apart by 2–3 mm and opposed each other. The electrodes 117 and 119 extend over a distance longer than the length of the SLA 104*a*. The electrodes 117 and 119 are longer than or as long as the image bearing body 101. The electrodes 117 and 119 are a plate of, for example, aluminum and have a thickness of about 0.2–0.4 mm. The surface of the electrodes 117 and 119 are preferably coated with a material that prevents the electrodes 117 and 119 from reflecting light.

<Operation>

The operation of the electrodes 117 and 119 will be described with reference to FIGS. 2–6.

Referring to FIGS. 2–6, dotted lines show the distribution of potential and solid lines show the direction of electric lines of force.

Seven different experiments were conducted by varying the output voltages of the two external high voltage power supplies 118 and 120 connected to the two electrodes 117 and 119, respectively.

The image bearing body 101 was charged to −800 V. Table I list the experiment results. The results are expressed in three soiling levels: Symbol o indicates that the exposing unit 104 is not soiled. symbol Δ indicates that the exposing unit 104 is dirty but the print quality is not significantly degraded. Symbol X indicates that light amount decreased and decreased light caused poor print quality.

TABLE I

| | Voltage on Electrode 117 (V) | Voltage on Electrode 119 (V) | soiling level |
|---|---|---|---|
| Ex. I | +400 | +400 | X |
| Ex. II | 0 | 0 | X |
| Ex. III | −1350 | −1350 | X (FIG. 2) |
| Ex. IV | −400 | −400 | X (FIG. 3) |
| Ex. V | −400 | −1350 | X (FIG. 4) |
| Ex. VI | −1350 | −400 | Δ (FIG. 5) |
| Ex. VII | −1350 | −200 | ○ |

Experiment I

A voltage of +400 V was applied to the electrodes 117 and 119. Since most of the residual toner was negatively charged, there was developed a potential distribution that attracts the residual toner 107 toward the frame of the exposing unit 104 at the ground potential. The exposing unit 104 was subjected to soiling. The electrodes 117 and 119 also attracted a large amount of toner.

Experiment II

A voltage of 0 V (ground level) was applied to the electrodes 117 and 119. Just as in Experiment I, there was developed a potential distribution that attracts the residual toner 107 toward the frame of the exposing unit 104 at the ground potential. The exposing unit was subjected to soiling. The electrodes 117 and 119 also attracted a large amount of toner.

Experiment III

Figure 2:
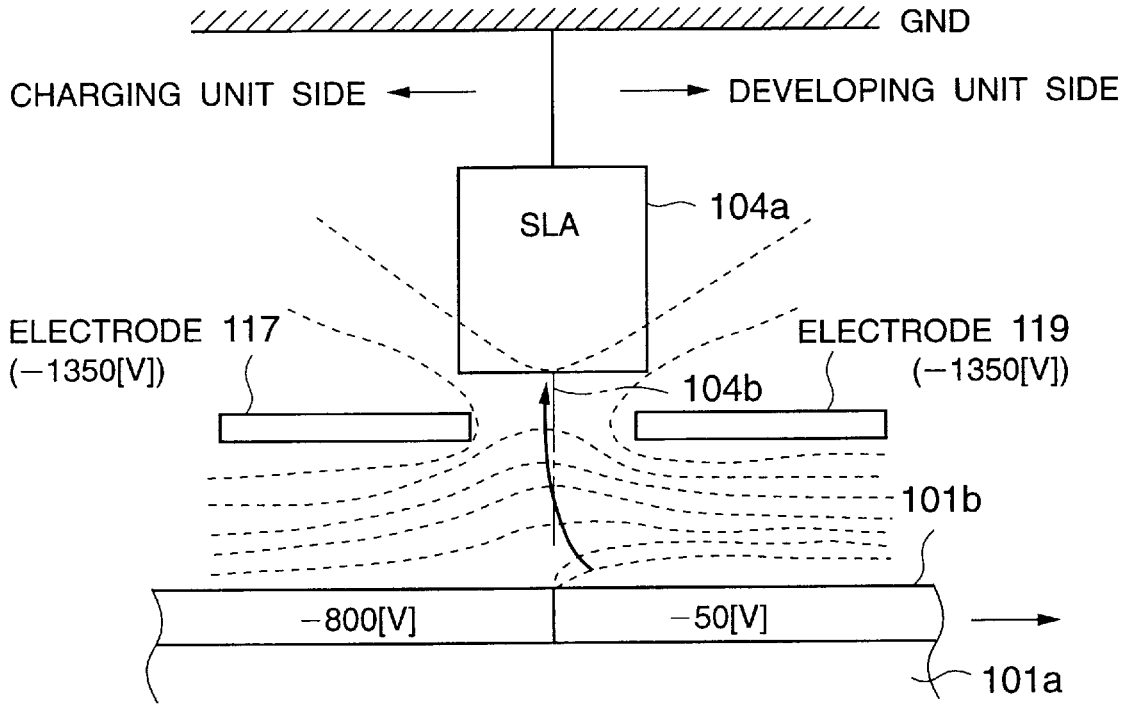
FIG. 2 illustrates the distribution of potential between the exposing unit and the image bearing body for Experiment III.

FIG. 2 illustrates the distribution of potential between the exposing unit and the image bearing body for Experiment III.

A voltage of −1350 V was applied to the electrodes 117 and 119. The distribution of potential was such that curved electric lines of force are developed between an exposed area (−50 V) and a non-exposed area (−800 V). The residual toner begins to fly from the exposed area to the non-exposed area, some of the residual toner passes through a gap between the electrodes 117 and 119 to the exposing unit 104 as shown in a solid arrow line, so that the toner 107 is deposited mostly on the SLA 104*a* of the exposing unit 104. The deposited toner caused less light to illuminate the image bearing body and poor print quality.

Experiment IV

Figure 3:
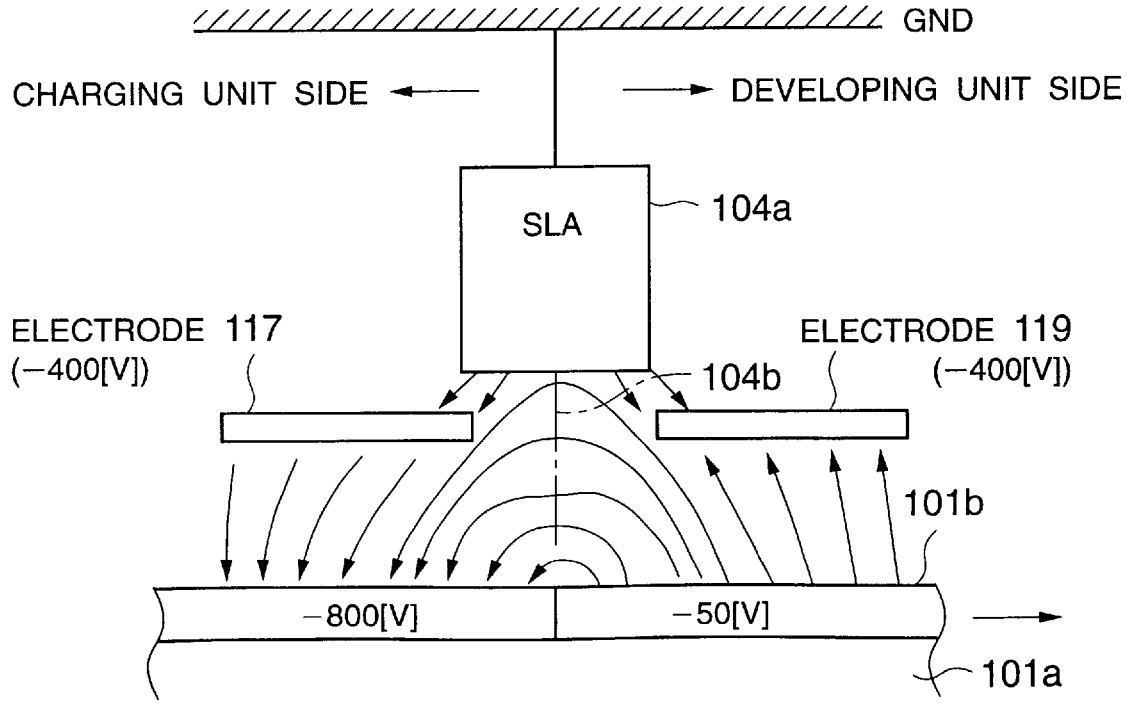
FIG. 3 illustrates the distribution of potential between the exposing unit and the image bearing body for Experiment IV.

FIG. 3 illustrates the distribution of potential between the exposing unit and the image bearing body for Experiment IV.

A voltage of −400 V was applied to the electrodes 117 and 119. The residual toner deposited on the SLA 104*a* reduced the amount of light that illuminates the image bearing body 101, and caused deterioration of print quality. However, the exposing unit 104 was soiled less, as compared to Experiment III.

It is assumed that the exposing unit was less soiled for the following reasons.

As shown in FIG. 3, sharply curved electric lines of force are created between the image bearing body 101 and the exposing unit 104. Thus, the toner flying along the electric lines of force in directions opposite to the arrows cannot curve sufficiently, reaching the exposing unit 104. Although all of the flying toner 107 reaches the exposing unit 104 in the Experiment III, only a portion of flying toner that failed to sufficiently curve is deposited on the exposing unit 104. Thus, less toner is deposited on the exposing unit 104.

Experiment V

Figure 4:
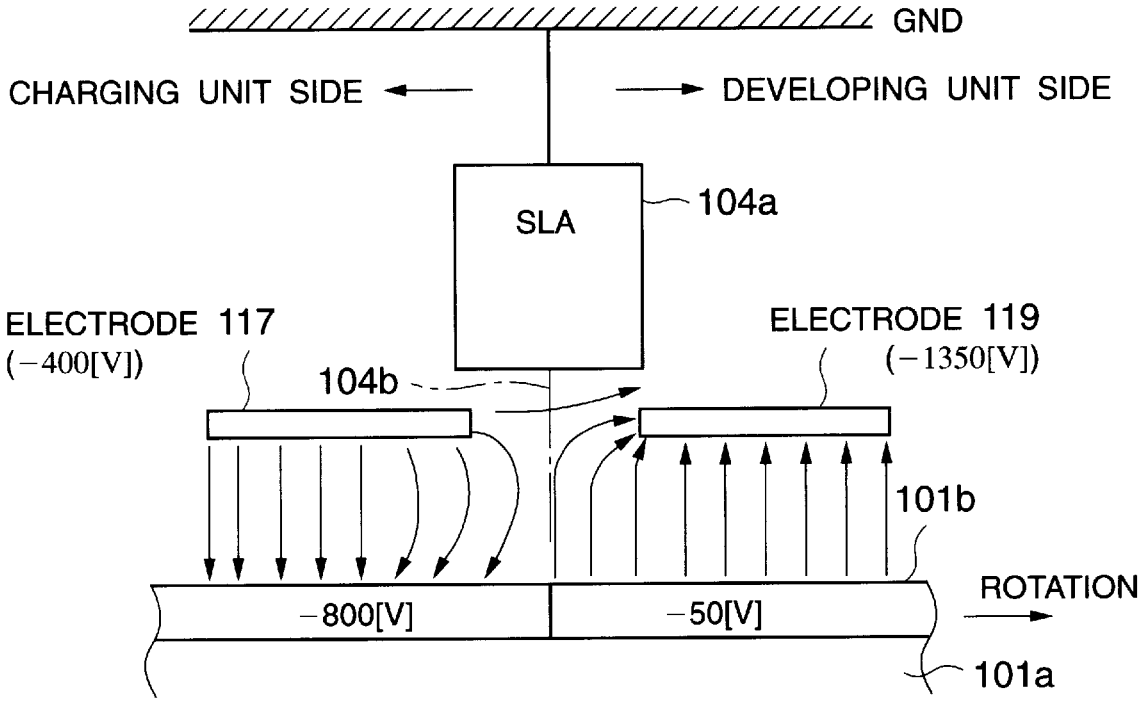
FIG. 4 illustrates the distribution of potential between the exposing unit and the image bearing body for Experiment V.

FIG. 4 illustrates the distribution of potential between the exposing unit and the image bearing body for Experiment V.

A voltage of −400 V was applied to the electrode 117 while a voltage of −1350 V was applied to the electrode 119. As shown in FIG. 4, a potential distribution was such that some of the electric lines of force between the exposing unit 104 and the surface of the image bearing body closer to the developing unit 105 were oriented toward the exposing unit 104. Thus, the exposing unit was soiled.

Experiment VI

Figure 5:
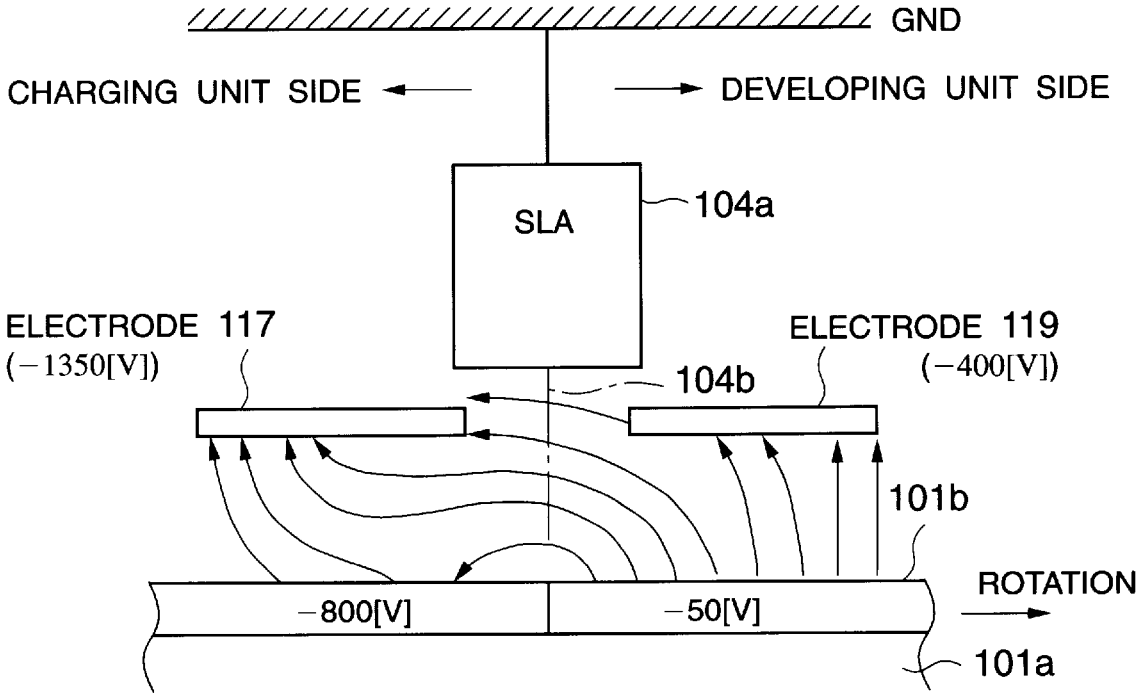
FIG. 5 illustrates the distribution of potential between the exposing unit and the image bearing body for Experiment VI.

FIG. 5 illustrates the distribution of potential between the exposing unit and the image bearing body for Experiment VI.

A voltage of −1350 V was applied to the electrode 117 while a voltage of −400 V was applied to the electrode 119. No decrease in light that illuminates the image bearing body 101 was observed.

This is for the following reasons.

As shown in FIG. 5, a potential distribution was such that the electric lines of force between the exposing unit 104 and the surface of the image bearing body 101 are inclined relative to the direction of light 104*b* emitted from the SLA 104*a* in a zone near the SLA 104*a*. As a result, a potential distribution in the gap between the exposing unit 104 and the image bearing body 101 is such that the residual toner 107 on the image bearing body 101 and the toner 107 in the air are allowed to fly in directions parallel to the lens surface of the SLA 104*a* and opposite to directions shown by arrows, i.e., the residual toner is collected on the illuminated areas on the image body 101.

However, there still is a chance for the toner 107 to be deposited on the lens surface of the SLA 104*a*, depending on the environment in which the electrophotography apparatus is placed.

Experiment VII

A voltage of −1350 V was applied to the electrode 117 and a voltage of −200 V, less negative than the voltage applied to the electrode 117, was applied to the electrode 119. As a result, the potential between the lens surface of the SLA 104*a* and the image bearing body 101 was such that the electric lines of force are more inclined relative to the direction of light of the SLA 104*a*. Thus, a large portion of electric lines of force is nearly perpendicular to the direction of light in the area where the light illuminates the image bearing body 101. This distribution of electric lines of force prevents the toner from flying toward the SLA 104*a*. Thus, no toner is deposited on the exposing unit 104 and a sufficient amount of light illuminates the surface of the image bearing body 101.

Figure 6:
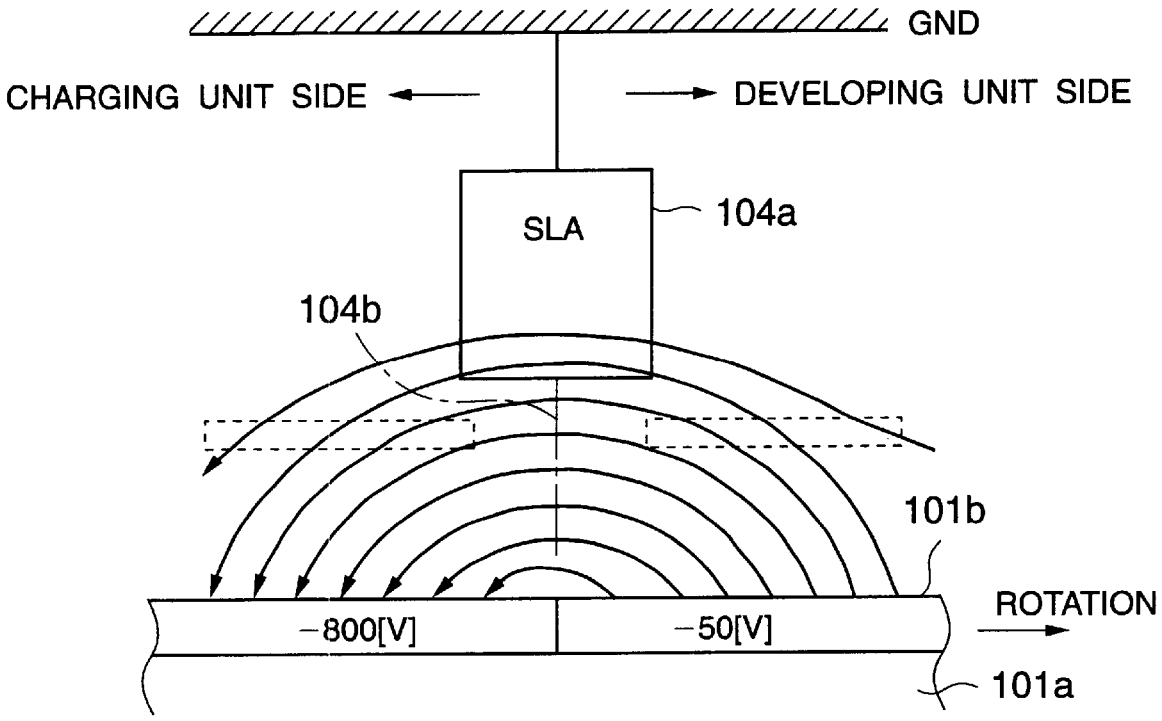
FIG.6 PRIOR ART
FIG. 6 illustrates the conventional art apparatus which has no electrodes such as electrodes according to the invention.

FIG. 6 illustrates the conventional art apparatus which has no electrodes such as electrodes 117 and 119 of the present invention. Electric lines of force describe parabolic curves that are oriented from exposed areas (−50 V) to non-exposed areas (−800 V). The residual toner 107 flies along the electric lines of force in directions opposite to arrows, reaching the SLA 104*a* and causing soiling of the lens surface thereof.

As described above, a negative voltage is applied to the electrode 117, which is close to the charging unit 102. This voltage is more negative than that applied to the electrode 119, which is close to the developing unit 105. The polarity of the voltage applied to the electrodes 117 and 119 is the same as that of the residual toner 107, preventing the toner 107 from adhering to the electrodes 117 and 119. Therefore, no toner is deposited on an LED type exposing unit over a long term use and stable print quality is ensured. The provision of the electrodes 117 and 119 also prevents soiling of the exposing unit 104 with the toner 107 even when the printer is operated in high-temperature and high-humidity environment and in low-temperature and low humidity environment.

Second Embodiment

Figure 7:
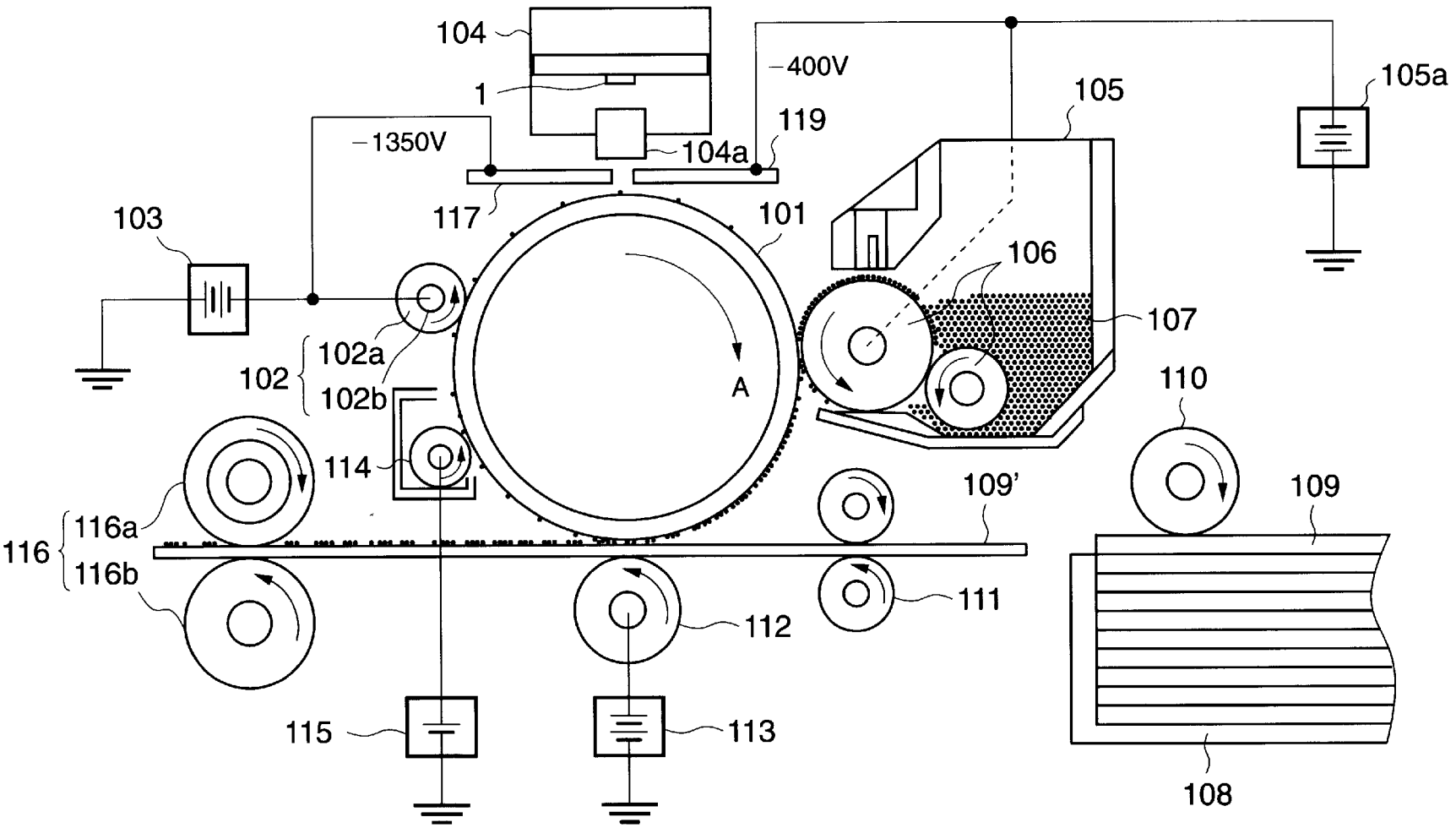
FIG. 7 illustrates a general construction of an electrophotography apparatus according to a second embodiment, the apparatus having electrodes that prevent toner from adhering to the exposing unit.

FIG. 7 illustrates a general construction of another electrophotography apparatus having electrodes that prevent toner from adhering to the exposing unit.

The construction shown in FIG. 7 differs from that shown in FIG. 1 in that the electrode 117 is connected to the charging power supply 103 and the electrode 119 is connected to a bias power supply 105*a* of the developing unit 105. The rest of the construction is the same as that of the first embodiment.

The operation of the apparatus shown in FIG. 7 will be described with respect to only a part different from the first embodiment.

Just as in the first embodiment, the residual toner 107 on the image bearing body 101 cannot be removed completely by the cleaning roller 114. The residual toner 107 remaining on the image bearing body 101 is carried to the charging unit 102 and exposing unit 104 as the image bearing body 101 rotates. Voltages are applied to the electrodes 117 and 119 so as to control the potential distribution between the exposing unit 104 and the image bearing 101.

Table II lists the test results when the electrodes 117 and 119 were connected to the charging power supply 103 and the bias power supply 105*a*, respectively, and vice versa. Symbol o indicates that the exposing unit 104 was not soiled at all. Symbol X indicates that the amount of light emitted from the exposing unit was decreased and print quality was deteriorated.

The charging power supply 103 is controlled to output a voltage of −1350 V and the bias power supply 105*a* is controlled to output a voltage of about −400 V.

TABLE II

| | Voltage on Electrode 117 (V) | Voltage on Electrode 119 (V) | soiling level |
|---|---|---|---|
| Ex. I | APPROX. −1350 (supply 105a) | APPROX. −350 (supply 103) | ○ |
| Ex. II | APPROX. −350 (supply 103) | APPROX. −1350 (supply 105a) | X |

Experiment I

A voltage of −1350 V was applied to the electrode 117 and a voltage of −350 V was applied to the electrode 119. It is to be noted that the voltage applied to the electrode 117 is more negative than that applied to the electrode 119. The distribution of potential is such that electric lines of force between the exposing unit 104 and the image bearing body 101 are substantially perpendicular to the direction of light emitted from the SLA 104*a*. This is equivalent to that shown in FIG. 2. The residual toner 107 flies between the exposing unit 104 and the image bearing body 101 in a direction parallel to the lens surface, i.e., substantially perpendicular to the direction of light. Thus, the residual toner 107 does not fly toward the exposing unit 104, preventing decreases in the amount of light emitted from the exposing unit 104.

Experiment II

A voltage of −350 V was applied to the electrode 117 and a voltage of −1350 V was applied to the electrode 119. It is to be noted that the voltage applied to the electrode 117 is less negative than that applied to the electrode 119. The toner 107 was deposited on the exposing unit 104, decreasing the amount of light emitted from the exposing unit 104 and print quality accordingly. It may be due to the fact that the electric lines of force were parallel to the direction of light emitted from the exposing unit 104 and the toner 107 flied along the direction of light emitted from the exposing unit 104.

The second embodiment is more advantageous in reducing the manufacturing cost of the apparatus and miniaturizing the apparatus than the first embodiment in that the existing charging power supply 103 and bias power supply 105*a* can be used as the bias power supplies for the electrodes 117 and 119, respectively.

Third Embodiment

Figure 8:
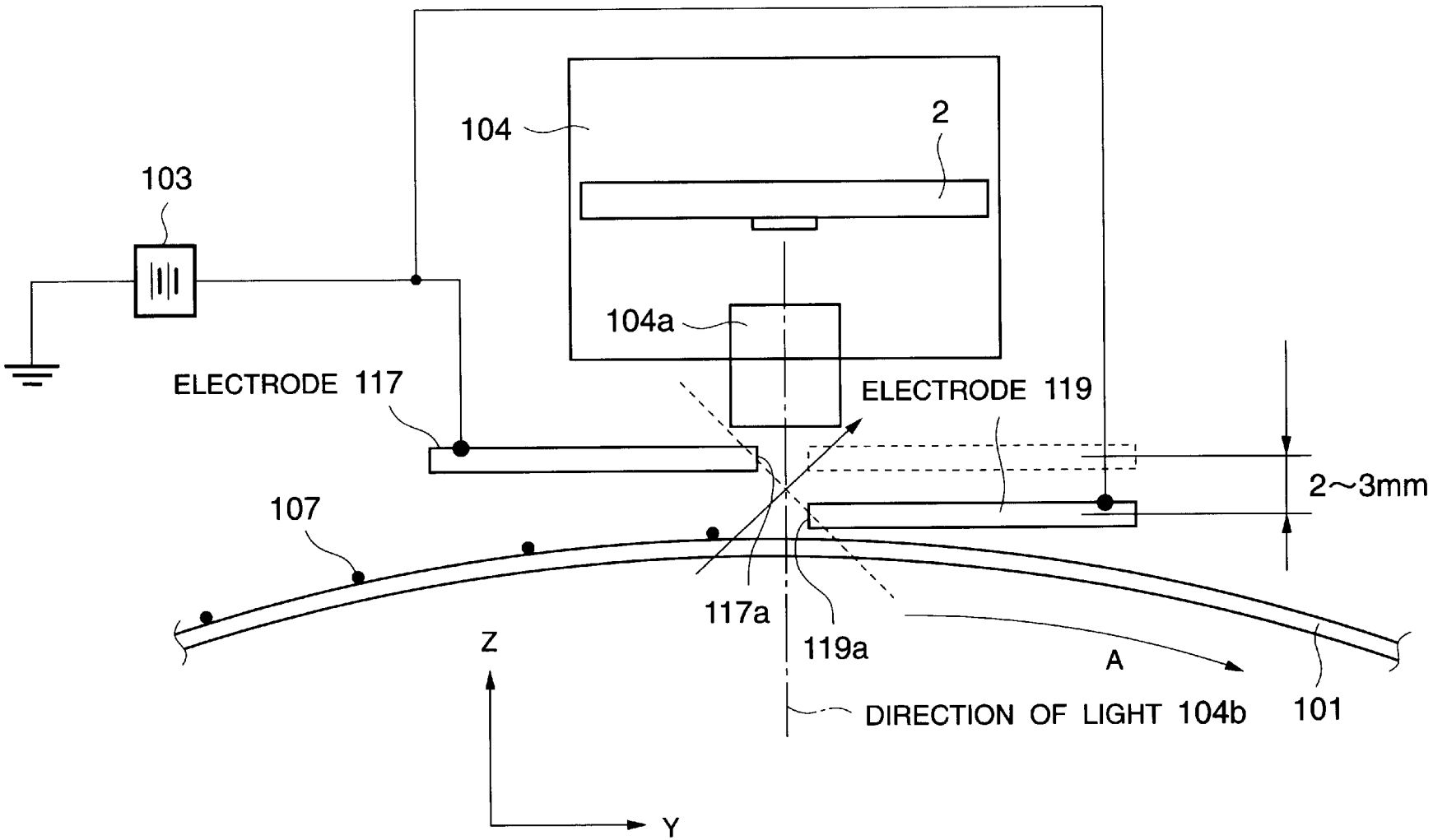
FIG. 8 illustrates a general construction of an exposing unit according to a third embodiment.
Figure 9:
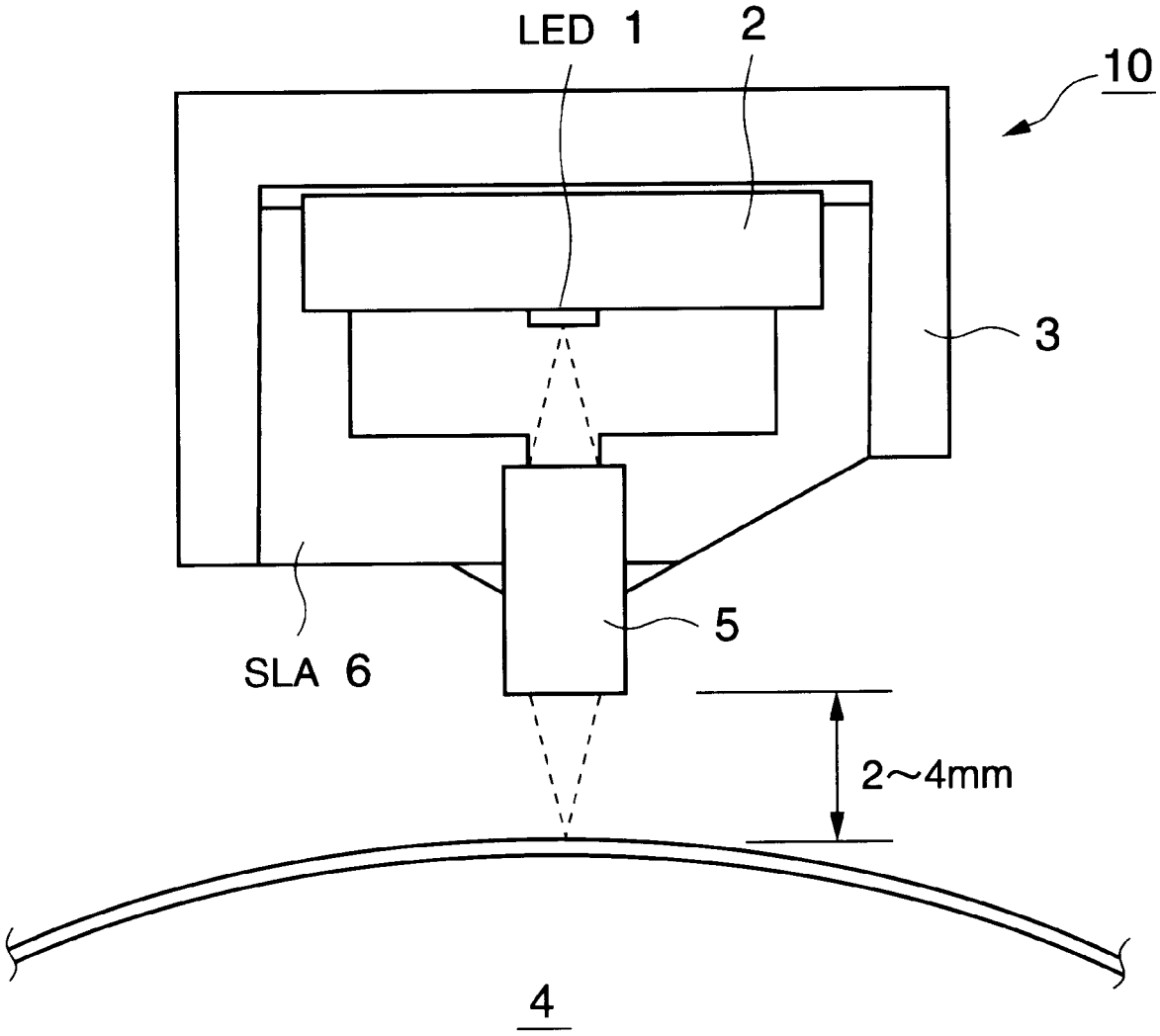
FIG.9 PRIOR ART
FIG. 9 illustrates a general construction of a conventional exposing unit.

FIG. 8 illustrates a general construction of an exposing unit according to a third embodiment. The exposing unit has electrodes that prevent toner from adhering to the exposing unit.

The third embodiment differs from the first embodiment in that the electrodes 117 and 119 are disposed at positions asymmetric with respect to the direction of light 104*b* emitted from the exposing unit 104. Both the electrodes 117 and 119 may be connected to the charging power supply, not shown. The rest of the construction is the same as that of the first embodiment.

The exposing unit shown in FIG. 8 is basically the same as that of the first embodiment. Thus, only a part different from the first embodiment will be described.

Just as in the first embodiment, the residual toner 107 on the image bearing body 101 cannot be removed completely by the cleaning roller. The residual toner remaining on the image bearing body 101 is carried to the charging unit 102 and exposing unit 104 as the image bearing body 101 rotates. Voltages are applied to the electrodes 117 and 119 so as to control the potential distribution between the exposing unit 104 and the image bearing body 101.

For example, the electrode 117 is located at a fixed position and the electrode 119 is moved 2–3 mm closer to the image bearing body 101 than from a position where the electrode 119 was symmetric with respect to the electrode 117. When a voltage of −1350 V is applied to the electrodes 117 and 119, an electric field is developed at an angle of about 45 degrees with the direction of light 104*b* emitted from the exposing unit 104 as depicted by a solid arrow line. The toner flies along the electric field in a direction oblique to the direction of light 104*b*, thus not reaching the SLA 104*a* of the exposing unit 104. The construction of the third embodiment is more effective in preventing soiling of the exposing unit, deterioration of print quality, and decrease in the amount of light emitted from the exposing unit 104, than the first and second embodiments when improper voltages are to the electrodes 117 and 119.

In the first embodiment, the electrodes are disposed such that the electrodes symmetric with respect to the direction of light. If the electrodes are 1–2 mm away from the direction of light and a voltage of −1350 V is applied to the electrodes 117 and 119, then an electric field between the exposing unit 104 and image bearing body 101 is parallel to the direction of light 104*b* emitted from the exposing unit 104. Therefore, the toner 107 flies toward the exposing unit 104, adhering to the exposing unit 104.

In contrast to this, in the third embodiment, applying a common voltage of −1350 V to the electrodes 117 and 119 can create an electric field such that the toner 107 does not adhere to the exposing unit 104 just as in Experiments VI and VII of the first embodiment.

The similar results can be obtained even if the electrodes 117 and 119 are connected to separate external power supplies in stead of the charging power supply 103 shown in FIG. 1.

The third embodiment requires only one power supply existing in the electrophotography apparatus and therefore lends itself to miniaturizing the apparatus and reducing the cost of the apparatus. The present invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. An electrophotography apparatus having a charging unit that charges the surface of a rotating image bearing body having an axis of rotation, an exposing unit that emits light to illuminate, during a printing operation, the surface of the image bearing body to form an electrostatic latent image on the surface, and a developing unit that applies charged fine powder particles to the electrostatic latent image to develop the electrostatic latent image, the apparatus comprising:

at least one power supply; and a pair of electrodes disposed between the image bearing body and the exposing unit and aligned on opposite sides of the light and parallel to the axis of rotation of the image bearing body, said electrodes receiving voltages from said power supply, to create electric lines of force at an angle with the direction of the light so that charged residual powered particles remaining on the image bearing body fly in a direction deviating from the direction of the light and are collected, during the printing operation, on the illuminated areas of the image bearing body.

2. The electrophotography apparatus according to claim 1, wherein said electrodes include a first electrode and a second electrode that are disposed in a plane perpendicular to the direction of light, the first and second electrodes receiving voltages of different values and of the same polarity as the charged powdered particles.

3. The electrophotography apparatus according to claim 2, wherein the charging unit and developing unit receive voltages from corresponding external power supplies, and said first electrode receives the same voltage as the charging unit and the second electrode receives the same voltage as the developing unit.

4. The electrophotography apparatus according to claim 1, wherein said electrodes include a first electrode and a second electrode disposed in different planes perpendicular to the direction of light, the second electrode being closer to the image bearing body than the first electrode.

* * * * *